US008763932B2

(12) United States Patent
Niggemann

(10) Patent No.: US 8,763,932 B2
(45) Date of Patent: Jul. 1, 2014

(54) DEVICE AND SPRAY HEAD FOR ATOMIZING A PREFERABLY COSMETIC LIQUID BY MEANS OF A THROTTLE DEVICE, AND METHOD FOR PRODUCING SUCH A DEVICE

(75) Inventor: Klaus Niggemann, Unna (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 909 days.

(21) Appl. No.: 11/570,649

(22) PCT Filed: Jun. 13, 2005

(86) PCT No.: PCT/EP2005/006295

§ 371 (c)(1),
(2), (4) Date: Dec. 14, 2006

(87) PCT Pub. No.: WO2005/120988

PCT Pub. Date: Dec. 22, 2005

(65) Prior Publication Data

US 2007/0272767 A1 Nov. 29, 2007

(30) Foreign Application Priority Data

Jun. 14, 2004 (DE) ..... 10 2004 028 440
Jul. 16, 2004 (DE) ..... 10 2004 034 629

(51) Int. Cl.
*B05B 7/32* (2006.01)
*B05B 9/03* (2006.01)
*B05B 1/30* (2006.01)

(52) U.S. Cl.
USPC ..... 239/337; 239/302; 239/579; 239/583

(58) Field of Classification Search
CPC ..... B65D 83/44; B65D 83/20; B65D 83/48; B65D 83/203; B65D 83/205; B65D 83/207; B65D 83/50; B65D 83/52; B65D 83/525; B65D 83/54; B65D 83/543; B65D 83/546; B65D 83/7535; B05B 1/3006; B05B 1/3473; B05B 1/3436; B05B 1/3026; B05B 1/326; B05B 1/308; B05B 1/3086; B05B 1/3013; B05B 1/3033; B05B 1/304; B05B 11/0067
USPC ..... 239/337, 302, 569, 579, 583; 222/402.1, 402.18; 251/120, 121
See application file for complete search history.

(56) References Cited

U.S. PATENT DOCUMENTS 3,008,654 A * 11/1961 Abplanalp et al. ..... 239/468
3,085,753 A * 4/1963 Braun et al. ..... 239/337

(Continued)

FOREIGN PATENT DOCUMENTS

DE 1750671 A1 2/1971
DE 1653398 A1 8/1971

(Continued)

*Primary Examiner* — Jason Boeckmann
*Assistant Examiner* — Steven M Cernoch
(74) *Attorney, Agent, or Firm* — Roberts Mlotkowski Safran & Cole, P.C.; David S. Safran

(57) ABSTRACT

A device (1) and a spray head (5) for atomization of a preferably cosmetic liquid and a process for producing such a device are proposed. Very simple and accurate throttling of the liquid flow is achieved in that on the supply connection (14) of the spray head (5) a radially open throttling channel (22) is formed which is radially overlapped at least in sections by a connector piece (17) when the spray head (5) has been slipped on.

13 Claims, 2 Drawing Sheets

(56) References Cited

U.S. PATENT DOCUMENTS

| | | | | | |
|---|---|---|---|---|---|
| 3,314,571 | A | * | 4/1967 | Greenebaum, II | 222/135 |
| 3,813,043 | A | * | 5/1974 | Mordehai | 239/204 |
| 4,085,895 | A | * | 4/1978 | Curry et al. | 239/276 |
| 4,154,374 | A | * | 5/1979 | Kirk, Jr. | 222/321.2 |
| 4,396,152 | A | * | 8/1983 | Abplanalp | 239/337 |
| 4,486,039 | A | * | 12/1984 | Jayne | 291/3 |
| 4,723,725 | A | * | 2/1988 | Comment | 239/533.1 |
| 4,830,284 | A | * | 5/1989 | Maerte | 239/333 |
| 4,940,170 | A | * | 7/1990 | Popp-Ginsbach | 222/402.1 |
| 5,195,665 | A | * | 3/1993 | Lina | 222/496 |
| 5,368,201 | A | * | 11/1994 | Fuchs | 222/162 |
| 5,417,357 | A | * | 5/1995 | Yquel | 222/402.24 |
| 5,458,289 | A | * | 10/1995 | Cater | 239/119 |
| 5,884,819 | A | * | 3/1999 | Fuchs et al. | 222/321.2 |
| 5,901,883 | A | * | 5/1999 | Ritsche | 222/137 |
| 6,036,059 | A | * | 3/2000 | VanBrocklin | 222/321.9 |
| 6,345,737 | B1 | * | 2/2002 | Martin et al. | 222/320 |
| 6,412,516 | B1 | * | 7/2002 | Goldsmith | 137/454.6 |
| 6,415,989 | B1 | * | 7/2002 | Lasserre et al. | 239/1 |
| 7,302,948 | B2 | * | 12/2007 | Anderson | 128/200.14 |
| 7,322,505 | B2 | * | 1/2008 | Ishizawa et al. | 227/130 |
| 7,726,522 | B2 | * | 6/2010 | Greiner-Perth | 222/321.6 |
| 2002/0074429 | A1 | * | 6/2002 | Hettrich et al. | 239/333 |
| 2003/0150937 | A1 | * | 8/2003 | Laidler et al. | 239/340 |
| 2006/0249543 | A1 | * | 11/2006 | Pardonge et al. | 222/402.1 |

FOREIGN PATENT DOCUMENTS

| | | | | |
|---|---|---|---|---|
| DE | 1653398 | B | * | 2/1978 |
| EP | 0826608 | A1 | | 3/1998 |

* cited by examiner

DEVICE AND SPRAY HEAD FOR ATOMIZING A PREFERABLY COSMETIC LIQUID BY MEANS OF A THROTTLE DEVICE, AND METHOD FOR PRODUCING SUCH A DEVICE

BACKGROUND OF THE INVENTION

1. Field of the Invention

This invention relates to a device for atomization of a preferably cosmetic liquid with a nozzle for atomization of the liquid and a process for producing such a device.

2. Description of Related Art

The concept of "cosmetic liquid" includes in a narrow sense hair spray, hair lacquer, a deodorant, a foam, a gel, a coloring spray, a sunscreen or skin care agent or the like. Preferably, in a wider sense, also other body care products, cleaning products, cosmetics, or the like, and also suspensions and fluids, especially with gaseous phases, are included. However, other liquids, for example, air fresheners, and especially also technical liquids and fluids, such as rust looseners or the like, can also be used. But, for reasons of simplification and based on the focus of use often only cosmetic liquids are addressed below.

A device for atomizing of a cosmetic liquid, such as hair spray, is known from practice, a container which contains the liquid having a valve, with a spray head which can be slipped onto its connector piece. When the spray head is pressed down the valve is opened, the liquid flowing through a throttling channel which forms a throttle radially into an axial recess of the connector piece and then into the spray head. The connector piece here at the same time forms an actuatable valve element and is preferably injected or injection molded in one piece from plastic. Production of a throttle valve is comparatively complex, since a separately movable mandrel or the like must be used.

In the known device, the tolerances for the throttle or the throttling channel are very small in order to be able to ensure the required or desired throttling action and thus the desired spray behavior of the device. This applies especially to the cross section and diameter of the throttling channel, since the length of the throttling channel is only relatively small, especially based on its radial alignment. In mass production it is relatively difficult to adhere to tolerances. This applies especially when liquids which are pressurized for example by volatile, easily flammable, especially organic propellants, by compressed gas and/or by carbon dioxide, require stronger throttling actions, therefore still smaller throttling cross sections and diameters.

Another disadvantage of the known device is that for different liquids or products to be atomized different throttling effects, therefore different throttling channel cross sections, and thus different valves and generally also different spray heads are necessary.

SUMMARY OF THE INVENTION

The object of this invention is to devise a device and a spray head for atomizing of a preferably cosmetic liquid and a process for producing and using such a device, and a throttle with if necessary very strong throttling action with high precision can be easily, and thus, economically achieved.

This object is achieved by a device and a process as described below.

The basic idea of this invention is that the spray head has or forms a second or the sole throttle for the liquid which is flowing through upstream of its nozzle. This leads to several advantages. By using a spray head with the desired throttling action, often, the same valve can be used for different applications. This simplifies production and mounting of the devices in accordance with the invention. Furthermore, if necessary, a stronger throttling action with high tolerances can be achieved by the formation of a single or additional throttle on the spray head in accordance with the invention, for example, by combination or serial connection of the first throttle on the valve and the second throttle on the spray head.

In this invention, the concept of "on the spray head" with respect to the arrangement of the (second) throttle should be understood in that the throttle can also be formed on the transition from the valve to the spray head, especially therefore also from the interaction of a connector piece of the container-side valve and of the spray head in the mounted state.

Another aspect of this invention which can also be independently implemented is that the throttle has a throttling channel which is produced preferably by injection molding first in the form of an especially groove-shaped or notch-shaped recess which is open on the lengthwise side, and only then is at least partially covered on the lengthwise side by a separately produced connector piece, especially when the spray head is slipped on or the device is otherwise assembled. This throttling channel can be produced especially easily by injection molding and with a very high tolerance due to a corresponding crosspiece in the injection mold or the like. This applies especially when the throttling channel is formed along a preferably cylindrical or hollow cylindrical section. The throttling channel can then be produced without additional effort, especially with a very simple injection mold without a movable mandrel or the like.

Another advantage of the indicated throttling channel is that its effective length, therefore the cover length or total length, and thus the throttling action or the flow resistance of the throttle can be varied quite easily with high precision.

The execution of the throttle in accordance with the invention with a throttling channel which is open first on the lengthwise side is preferably provided on the spray head or transition from the valve to the spray head, especially the throttling channel being at least partially covered during mounting or when the spray head is slipped on the container or its valve, by which an additional mounting or production step is not necessary. However, the throttle execution in accordance with the invention in addition or alternatively to production of another throttle can be used in the device for atomizing the liquid or a similar device.

Other advantages, features, properties and aspects of this invention will become apparent from the following description of a preferred embodiment with reference to the accompanying drawings.

DETAILED DESCRIPTION OF THE INVENTION

The same reference numbers are used for the same or similar parts in the figures, the corresponding or comparable properties and advantages being achieved even if a repeated description is omitted.

Figure 1:
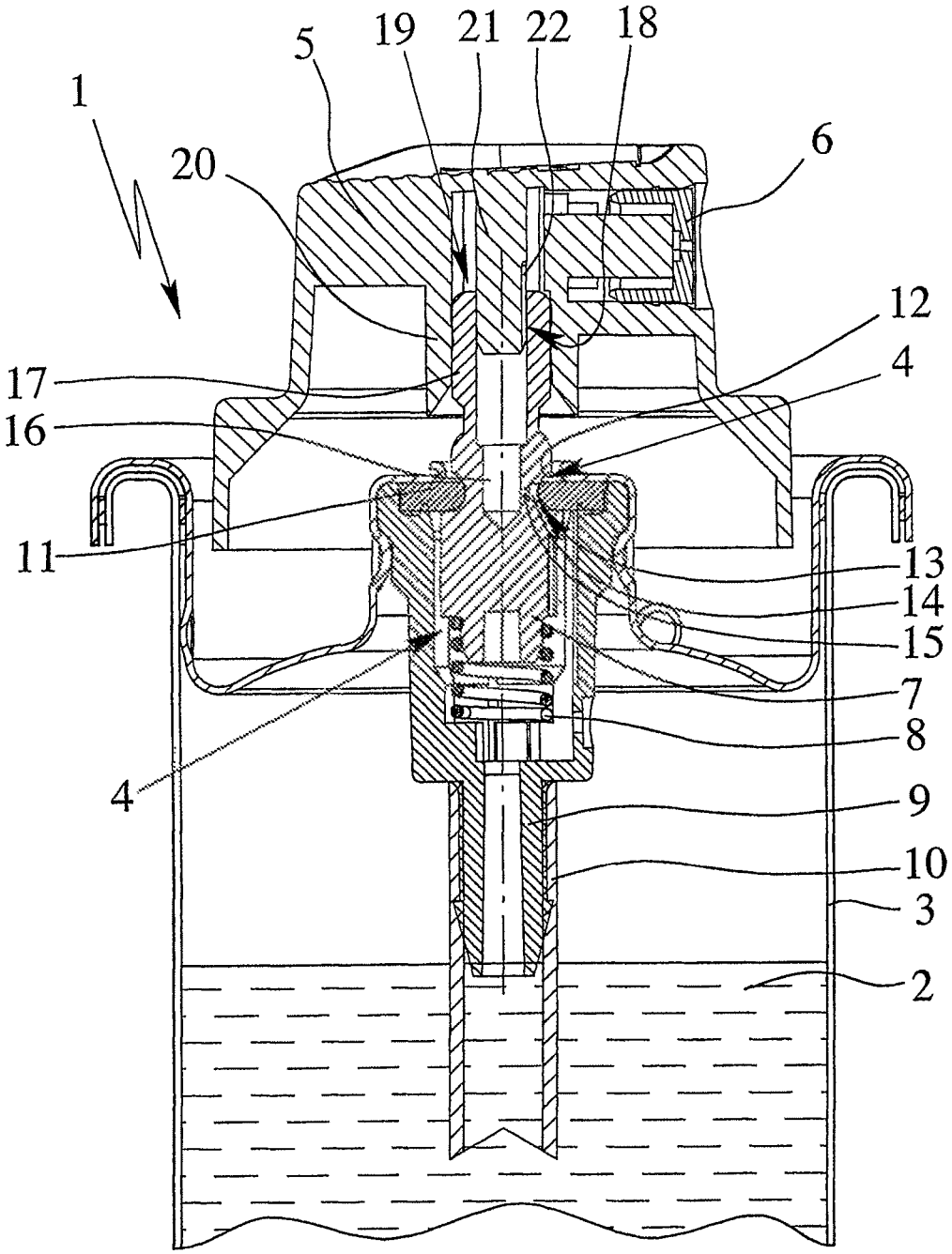
FIG. 1 shows a schematic cross section of a device in accordance with the invention for atomizing a cosmetic liquid with the valve closed.

FIG. 1 shows in a schematic cross section a device 1 in accordance with the invention for atomizing a preferably cosmetic liquid 2 or the like which has a container 3 for the liquid 2 and a valve 4 located preferably on the front on the container 3.

A spray head 5 is attached to the container 3, especially after filling the container 3 with the liquid 2. In the illustrated example, the spray head 5 has been slipped on. However, it can also be attached in an otherwise suitable manner, if necessary detachably.

The delivery side of the spray head 5 has a nozzle 6 for atomizing the liquid 2 and for discharge. In the illustrated example, the nozzle 6 is made as a separate part and is inserted, for example, subsequently into the spray head 5 or injected into it. However, the nozzle 6 can also be made integrally with the spray head 5, especially can be formed especially directly by it.

The spray head 5 is produced preferably by injection molding from a suitable plastic and is made preferably in one piece, optionally with the exception of the nozzle 6.

The liquid 2 in the container 3 can either be pressurized or is under pressure. In particular, the container 3 or the liquid 2 contains a suitable propellant, preferably a volatile and/or flammable propellant, compressed gas and/or carbon dioxide.

The valve 4 in the illustrated embodiment has an axially movable valve element 7 and a spring 8 which pretensions the valve element 7 in the illustrated embodiment up or out in the closing direction. The valve element 7 and the spring 8 are located in a valve housing 9 which is connected to the ascending line 10 for accommodating the liquid 2 in the illustrated embodiment.

In the illustrated embodiment, a sealing element 11 which is preferably at least essentially annular together with a matched recess 12 on the valve element 7 forms a valve seat 13.

Figure 2:
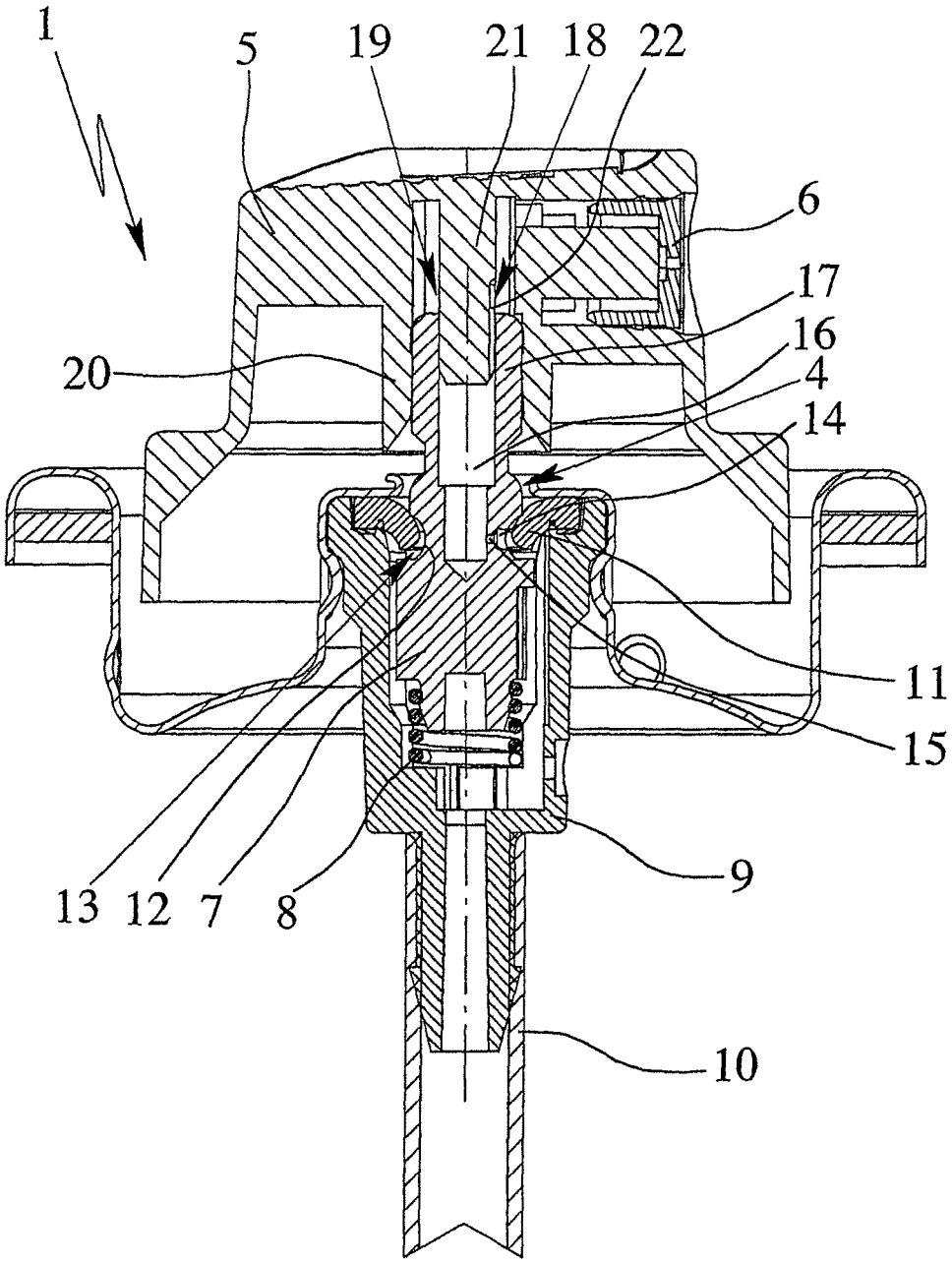
FIG. 2 shows an extract cross section of the device without a liquid and without the container with the valve opened.

When the valve 4 is actuated—in the illustrated embodiment by pressing the spray head 5 down—the valve 4 opens, as is shown schematically in FIG. 2, but without a container 3 and without a liquid 2. The pressurized liquid 2 can then flow through a passage 14 which runs radially in the illustrated embodiment and which is connected to the valve seat 13, with a following first throttle 15 into the axial recess 16 of the valve element 7. The axial recess 16 extends into the axially open connector piece 17 which is connected to the valve element 7 for the spray head 5.

The first throttle 15 can have for example a diameter of 0.20 to 0.50 mm, a diameter of 0.25 mm already being very difficult to produce with the desired tolerance, since the valve element 7—preferably together with the connector piece 17—is made especially in one piece and is produced by injection molding from a suitable plastic in mass production.

The valve 4 is especially a conventional valve 4 to which the conventional spray heads 5 can be connected. But other valve structures can also be implemented.

The spray head 5 in accordance with the invention has a (second) throttle 18 upstream of the nozzle 6. The second throttle 18 is located or formed in the illustrated embodiment on the supply side, especially in the region of a supply connection 19 of the spray head 5.

The supply connection 19 in the illustrated embodiment has an outer, preferably hollow cylindrical receiving section 20 with an insertion bevel on the free end to accommodate the connector piece 17. Accordingly the spray head 5 can be attached conventionally by slipping it onto the container 3 or its valve 4, especially onto the connector piece 17.

In the illustrated embodiment, the spray head 5 or supply connection 19 additionally has an inner, here cylindrical section 21. The second throttle 18 has a throttling channel 22 which in the illustrated embodiment is formed on the additional inner section 21 of the supply connection 9 of the spray head 5, in the form of a preferably groove-shaped or notch-shaped recess which is open radially to the outside and on the longitudinal side. The throttling channel 22 extends in the axial direction proceeding from the free end of the section 21 to beyond the free end of the connector piece 17 of the valve 4 when the connector piece 17 has been inserted in the spray head 5, so that in the illustrated embodiment the hollow cylindrical connector piece 17 at least partially covers the throttling channel 22 on its outer or lengthwise side. Accordingly, the liquid 2 can flow from the axial recess 16 through the throttling channel 22 and then through a recess, cavities and channels or the like which further adjoin within the spray head 5 to the nozzle 6, to be atomized and discharged there.

In the illustrated embodiment, the throttling action or function of the second throttle 18 is achieved on the one hand by interaction of the supply connection 19 and the inner section 21 of the spray head 5 and of the container-side connector piece 17 on the other. However, the throttle structure in accordance with the invention according to the second throttle 18 from other parts of the device 1 and of the spray head 5 and/or at other locations in addition or alternatively to the arrangement described in the embodiment can also be used.

The execution of the throttling channel 18 open on the lengthwise side allows first of all relatively simple production, also very small flow cross sections with low tolerances being attainable. This can be explained by the fact that in place of a very thin mandrel or the like a considerably more stable crosspiece or projection which can extend over the entire length of the throttling channel 22 which is to be formed on one wall of the casting mold can now be used.

In the region of the lengthwise-side cover—especially by the connector piece 17, another component or the like—the throttling channel 22 can have for example a clear cross section area which corresponds to a hole with a diameter of 0.25 mm, 0.20 mm or even only 0.15 mm or less. These small opening cross sections conversely cannot be produced in the form of radial passages or channels or the like solely by injection molding with adequate tolerance.

The second throttle 18 has a flow cross section which is less than or equal to the flow cross section of the first throttle 15. Preferably, the first throttle 15 has an inside diameter between 0.25 and 0.50 mm. But, the first throttle 15 can also be completely omitted if necessary. The second throttle 18, conversely, has a clear cross-sectional area which corresponds to a hole diameter of 0.10 mm to 0.50 mm, especially roughly 0.25 mm or less. This equivalent diameter is preferably smaller than the opening diameter of the downstream nozzle 6.

The flow resistance of the second throttle 18 is preferably greater than that of the first throttle 15. This can be achieved especially by a corresponding smaller opening area of the throttling channel 22. However, alternatively or additionally, this can also be easily established with great precision by the length of the throttling channel 22 which is relevant to the flow resistance, especially by the length of the covering or overlap by the connector piece 17 or other element.

As already indicated, if necessary, the first throttle 15 can also be completely omitted. However, the serial or successive connection of the first throttle 15 and of the second throttle 18 also has advantages. Thus, an especially strong throttling effect or especially high flow resistance, optionally, even for essentially the same flow resistances of the two throttles 15, 18, can be implemented, as is necessary for many liquids 2 or propellants, especially to make the volumetric or mass flow of atomized liquid 2 at least somewhat more independent of the propellant pressure. The spray head 5 in accordance with the invention can be very easily produced based on the simply additional inner section 21 with the throttling channel 22 and can be used together with conventional valves 4.

In the approach in accordance with the invention, the second throttle 18 is implemented especially easily, no additional mounting effort being necessary.

In other words, a device 1 and a spray head 5 for atomizing a cosmetic liquid 2 and a process for producing such a device are proposed. Very simple and accurate throttling of the liquid flow is achieved by a radially open throttling channel 22 being formed on the supply connection 19 of the spray head 5 and being radially overlapped at least in sections by a connector piece 17, with the spray head 5 slipped on.

What is claimed is:

1. Device for atomization of a pressurized liquid, with a container for the liquid, with a valve and with a spray head downstream of the valve, wherein the valve has a cylindrical section having a central axis, the cylindrical section projecting from an inner side of the spray head in an axial direction along said central axis and oriented toward the container; wherein the liquid can be atomized through a nozzle of the spray head with the valve opened, the device forming a throttle for the liquid, which is flowing through, upstream of the nozzle, the throttle comprising a slot-shaped, radially open throttling groove extending in said axial direction, the throttling groove having an longitudinally extending open side which is covered by a connector piece of the valve which extends towards the spray head in said axial direction, the connector piece being in sliding contact with the periphery of the cylindrical section except at the open side of said throttling groove, the portion of the length of the groove that is covered by the connector piece forming a flow conduit having an effective length which determines the flow resistance of the throttle, said effective length being settable by positioning of the cylindrical section relative to the connector piece.

2. Device as claimed in claim 1, further comprising a second throttle formed by the valve upstream of the throttle formed with the groove and connector piece.

3. Device as claimed in claim 2, wherein the flow resistance of the throttle formed with the groove and connector piece is greater than that of the second throttle.

4. Device as claimed in claim 1, wherein the spray head comprises a supply connection of which said cylindrical section forms a part.

5. Device as claimed in claim 1, wherein the spray head is detached from the valve to enable filling of the container with liquid.

6. Device as claimed in claim 4, wherein the spray head is attached to the valve by means of the supply connection.

7. Device as claimed in claim 1, wherein the flow resistance of the throttle is greater than that of the nozzle.

8. Device as claimed in claim 1, wherein the spray head is made in one piece with the nozzle.

9. Device as claimed in claim 1, wherein the spray head is made of injection molded plastic.

10. Device as claimed in claim 1, wherein the liquid is pressurized by at least one of a propellant, compressed gas, and carbon dioxide.

11. Device as claimed in claim 1, wherein the liquid is one of a hair spray, a hair lacquer, a deodorant, a foam, a gel, a coloring spray, a sunscreen, a skin care agent, a cleaning agent or an air freshener.

12. Device as claimed in claim 1, wherein the liquid is a cosmetic liquid.

13. Device as claimed in claim 1, wherein the throttling groove has a clear cross-sectional area corresponding to a hole diameter of 0.1 to 0.5 mm.

* * * * *